US006179177B1

(12) United States Patent
Hihara et al.

(10) Patent No.: US 6,179,177 B1
(45) Date of Patent: Jan. 30, 2001

(54) BAND

(75) Inventors: Hisashi Hihara, Fussa; Toru Kasai, Matsudo, both of (JP)

(73) Assignee: Casio Computer Co., Ltd., Tokyo (JP)

( * ) Notice: Under 35 U.S.C. 154(b), the term of this patent shall be extended for 0 days.

(21) Appl. No.: 09/318,052

(22) Filed: May 25, 1999

(30) Foreign Application Priority Data

Jun. 2, 1998 (JP) ..... 10-167818

(51) Int. Cl.[7] ..... A44C 5/18

(52) U.S. Cl. ..... 224/164; 224/166; 224/171; 224/176; 224/178; 224/221; 24/70 J; 24/71 J

(58) Field of Search ..... 224/166, 171, 224/176, 178, 221, 164; 368/281, 282; 24/68 J, 70 J, 71 J, 192, 193

(56) References Cited

U.S. PATENT DOCUMENTS

| | | | | |
|---|---|---|---|---|
| 58,430 | * | 10/1866 | Kelsey | 24/193 X |
| D. 240,368 | * | 6/1976 | Button | D11/3 |
| D. 310,174 | * | 8/1990 | Jacobi et al. | D10/32 |
| 374,377 | * | 12/1887 | Smith | 24/192 |
| D. 390,492 | * | 2/1998 | Riley | D11/5 |
| 409,779 | * | 8/1889 | Ferris | 24/193 |
| 491,123 | * | 2/1893 | McClure | 24/193 |
| 1,208,108 | * | 12/1916 | Davis | 24/170 |
| 1,333,421 | * | 3/1920 | Jolly | 24/186 |
| 1,576,689 | * | 3/1926 | Tost | 24/71 J |
| 1,917,151 | * | 7/1933 | Perrine | 24/192 |
| 3,641,630 | * | 2/1972 | Farley | 24/68 |
| 4,855,973 | | 8/1989 | Crocco . | |
| 4,905,879 | | 3/1990 | Piccone . | |
| 4,987,654 | * | 1/1991 | Mejias | 24/170 |
| 5,235,567 | | 8/1993 | Goodwin . | |
| 5,425,007 | | 6/1995 | Walter et al. . | |
| 5,769,290 | * | 6/1998 | Pestana | 224/178 |

* cited by examiner

*Primary Examiner*—Gregory M. Vidovich
(74) *Attorney, Agent, or Firm*—Frishauf, Holtz, Goodman, Langer & Chick, P.C.

(57) ABSTRACT

A band comprising: a first band member; a connecting ring attached to a left end portion of the first band member; a string attached to a right end portion of the first band member; a clasping fixture; and a hook member connected to the string by the clasping fixture; wherein the clasping fixture comprises first and second clasping rings and a releasing ring. When the band is attached to the wrist, a hook portion of the hook member is hooked to the connecting ring attached to the first band member and the string is pulled, so that the first and second clasping rings clasp the string. Accordingly, it is possible to attach the first band member to the wrist with suitable fitting without slacking. When the band is detached therefrom, by rotating the hook member by the releasing ring, it is possible to easily loosen to release the clasping of the string.

9 Claims, 14 Drawing Sheets

BAND

BACKGROUND OF THE INVENTION

1. Field of the Invention

The present invention relates to a band, such as a watch band or the like.

2. Description of Related Art

Conventionally, a watch band attached to a case and having a structure, as shown in FIG. 17 has been known.

Such a band comprises a band body 1 made of elastic rubber, a female buckle 2 attached on one end portion of the band body 1, and a male buckle 3 detachably attached on the other end portion thereof. In a state that the male buckle 3 is detached from the band body 1, the band body 1 is inserted into each insertion hole 6 of two band attachment portions 5 which are provided on a case complete 4, so that the case complete 4 can be attached to the band body 1. Thereafter, the male buckle 3 is attached to the other end portion of the band body 1.

In such a case, an attachment hole 2*a* into which the one end portion of the band body 1 is inserted is formed in the female buckle 2. The one end portion of the band body 1 is inserted into the attachment hole 2*a* to be turned back. By securing the turned and overlapped portions to each other, the female buckle 2 is attached to the one end portion of the band body 1.

Two attachment holes 3*a* and 3*b* into which the other end portion of the band body 1 is inserted are formed in the male buckle 3. By inserting the other end portion of the band body 1 into one attachment hole 3*a* and inserting a top end portion thereof into the other attachment hole 3*b* to be turned back, the male buckle 3 is detachably attached to the other end portion of the band body 1. A watch glass 7 is attached on an upper surface of the case 4, a case back 8 is attached on a lower surface thereof, and a watch module 9 is contained in an inside thereof.

However, according to the watch band, since the female buckle 2 is attached to the one end portion of the band body 1 made of elastic rubber, while the male buckle 3 is attached to the other end portion thereof, positions of the female buckle 2 and the male buckle 3 are not stable to tend to move when the band body 1 is attached to the wrist. Therefore, there is a problem that it is difficult to attach the female buckle 2 and the male buckle 3 by one hand.

Further, with the watch band, the other end portion of the band body 1 is inserted into the two attachment holes 3*a* and 3*b* of the male buckle 3 with being turned back in order, thereby the male buckle 3 is detachably attached to the other end portion of the band body 1. Accordingly, even if a length of the band body 1 is adjusted by the male buckle 3, the attached portion of the male buckle 3 maybe loosened. In this case, there is a problem that it is not possible to suitably fit the watch band to the wrist unless the length of the band body 1 is adjusted again.

SUMMARY OF THE INVENTION

An object of the present invention is to provide a band whose handling for attaching and detaching of a band body thereof to the wrist or the like is improved, and which can be attached to the wrist or the like with suitable fitting.

BRIEF DESCRIPTION OF THE DRAWINGS

FIGS. 3A to 3C show a hook member and a clasping fixture of FIG. 1; wherein FIG. 3A is an enlarged plan view thereof; FIG. 3B is an enlarged bottom view; and FIG. 3C is an enlarged left side view;

FIGS. 4A and 4B show cross-sections of FIG. 3A; wherein FIG. 4A is a cross-sectional view taken along the line 4A—4A of FIG. 3A; and FIG. 4B is a cross-sectional view taken along the line 4B—4B of FIG. 3A;

FIGS. 5A and 5B show two states that a string is clasped by the hook member and the clasping fixture of FIG. 3A; wherein FIG. 5A is an enlarged cross-sectional view showing a state that the string is inserted into the first and second clasping rings of the clasping fixture and before the string is clasped by them; FIG. 5B is an enlarged cross-sectional view showing a state that the string is clasped by the first and second clasping rings of the clasping fixture:

FIGS. 11A to 11C show a hook member and a clasping fixture of a watch band according to the second embodiment of the present invention; wherein FIG. 11A is an enlarged plan view thereof; FIG. 11B is an enlarged left side view thereof; and FIG. 11C is a cross-sectional view taken along the line 11C—11C of FIG. 11A;

PREFERRED EMBODIMENT OF THE INVENTION

Figure 17:
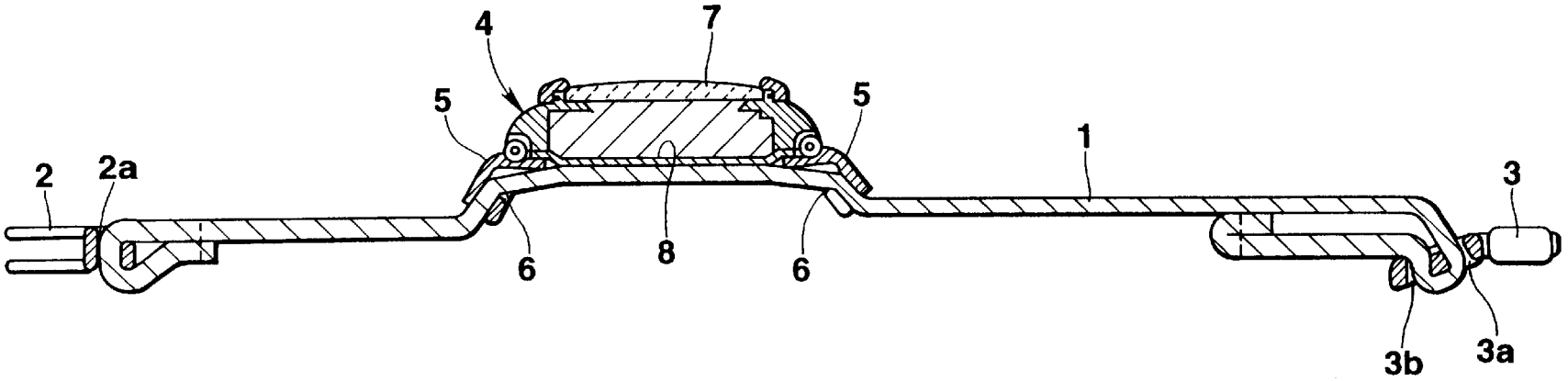
FIG.17 PRIOR ART
FIG. 17 is a cross-sectional view showing a former watch band.

First Embodiment:

Hereinafter, the band applied to a watch band, according to the first embodiment of the present invention will be explained with reference to FIGS. 1 to 7. To structural members, elements or the like in the first embodiment, corresponding to the former example shown in FIG. 17, the same reference numerals are attached, and the detailed explanation for them is properly omitted.

The watch band comprises a band body T having a first band member 10 to which a case 4 is attached and a second band member 11 attached to the first band member 10 such that the first band member overlaps the second band member, and a first fastening member 12 for detachably fastening the first band member 10 and the second band member 11 to each other. The first band member 10 has a double layered structure comprising an upper sheet 13 and a lower sheet 14, which are made of inelastic cloth. The first band member 10 is inserted into each insertion hole 6 of the two band attachment portions 5 which are provided on the case 4, so that the case 4 is attached to the first band member 10. The second band member 11 is made of inelastic cloth or elastic rubber and provided with a second fastening member 15 for detachably fastening both end portions 11*a* and 11*b* to each other, of the second band member 11.

The first band member 10 has a length which is shorter than that of the second band member 11. In one end portion, i.e., a right end portion 10*a* in FIG. 1, of the first band member 10, a string 16 described later is attached, while in the other end portion, i.e., a left end portion 10*b* in the Figure, a D-shaped connecting ring 17 is attached. In the case, at the right end portion 10*a* of the first band member 10, a right end portion of the upper sheet 13 wraps a portion of the string 16 to be turned back, and the turned back portion is sewn to be secured to the lower sheet 14 and also be secured to the second band member 11 by sewing. At the left end portion 10*b* of the first band member 10, a left end portion of the upper sheet 13 is inserted into the connecting ring 17 to be turned back and the turned back portion is sewn to be secured only to the lower sheet 14. Accordingly, the left end portion 10*b* of the first band member 10 is in a free state against the second band member 11. A woven name-sheet 13*a* is secured on an upper surface in a side of the right end portion 10*a* of the first band member 10, that is, on an upper surface in a side of the right end portion of the upper sheet 13.

The first fastening member 12 comprises a pair of sheet fasteners 12*a* and 12*b*, that is, a pair of sheets having resilient hook and loop fasteners (sold under the registered trademark "Magic Tape" or "VELCRO") which are attached to surfaces of the first band member 10 and the second band member 11, facing to each other. One sheet fastener 12*a* is attached to a lower surface of the lower sheet 14 of the first band member 10, while the other sheet fastener 12*b* is attached to an upper surface of the second band member 11. The sheet fastener l2*a* is attached to the position for the case 4 to be set thereon, of the lower sheet 14, while the sheet fastener 12*b* is attached to the second band member 11, extending from the position for the case 4 to be set thereon to the left end portion 11*b* of the second band member 11.

The second fastening member 15 comprises a pair of sheet fasteners 15*a* and 12*b* attached on facing surfaces of the overlapped portions to each other at the both end portions 11*a* and 11*b* of the second band member 11 when the second band member 11 is bent to be attached to the wrist. One sheet: fastener 15*a* is attached on a lower surface of the right end portion 11*a* of the second band member 11, while a side of the left end portion of the sheet fastener 12*b* of the first fastening member 12 serves as the other sheet fastener which is attached on an upper surface of the left end portion 11*b* of the second band member 11.

With the string 16, an approximately intermediate portion thereof is attached to the right end portion 10*a* of the first band member 10 and the string 16 is separated in two portions in both sides of the right end portion 10*a*. The two portions of the string 16 are extended to a further right side of the right end portion 10*a* of the first band member 10. A hook member 18 is connected to the extended portion of the string 16 by a clasping fixture 19. The two portions of the string 16 are turned back at the clasping fixture 19. On top end portions of the separated strings 16, a securing member 20 is attached. To the string 16 positioned between the right end portion 10*a* of the first band member 10 and the clasping fixture 19, a string holding piece, i.e., a string holding member 20 is attached movably along the string 16.

The hook member 18 is, as shown in FIGS. 3A to 4B, made of a metallic plate having an approximately rectangular shape. In a top end thereof, that is, a right end portion in FIG. 4A, a hook portion 18*a* is formed by bending downwardly to be turned back; at both sides along a longitudinal direction of the first band member 10, both side portions 18*b* are formed by bending downwardly; and a long hole l8*c* is formed in the both end portions 18*b*, along the longitudinal direction of the first band member 10.

Figure 3A:
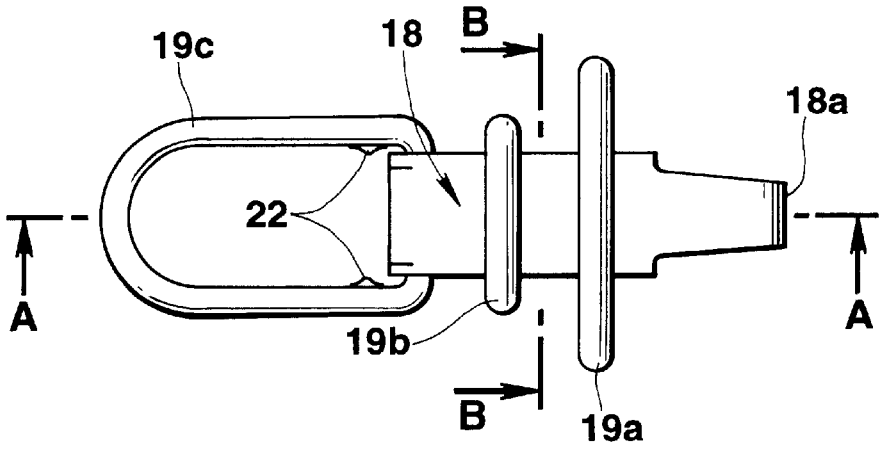
Figure 3B:
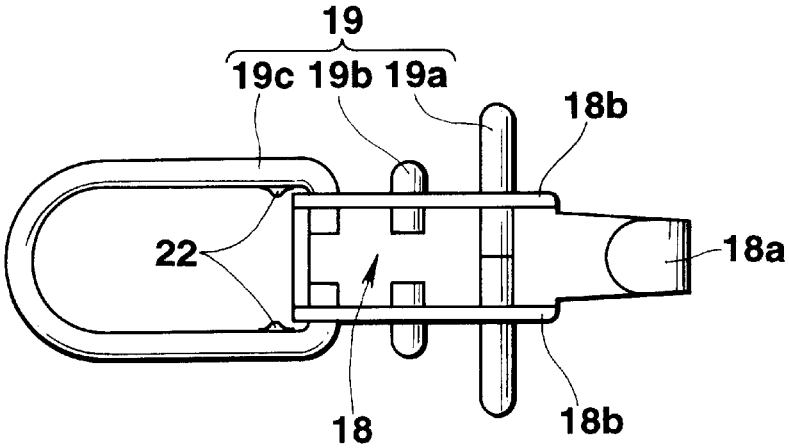
Figure 3C:
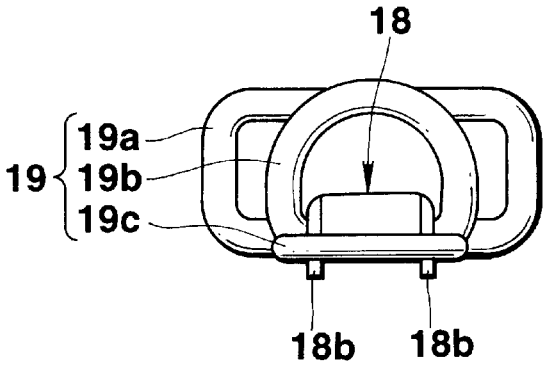
Figure 4A:
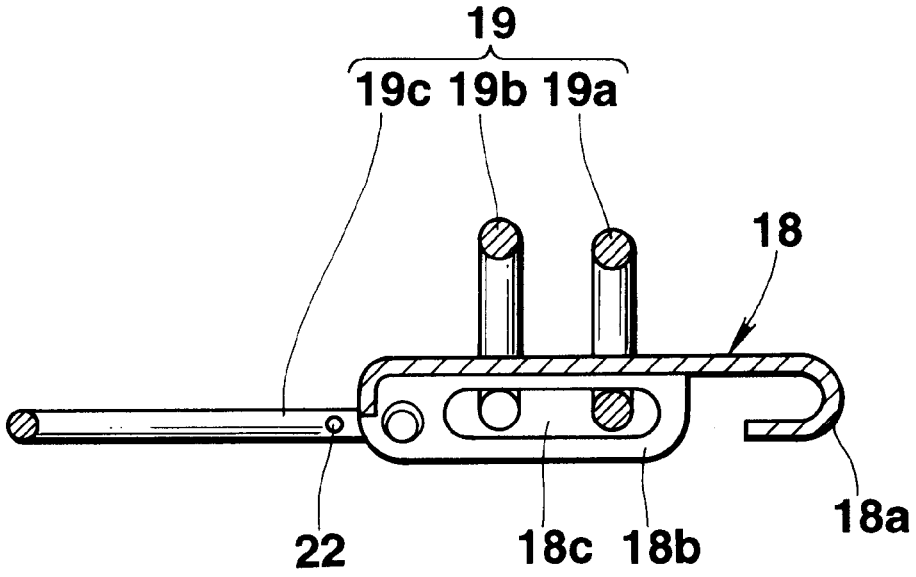
Figure 4B:
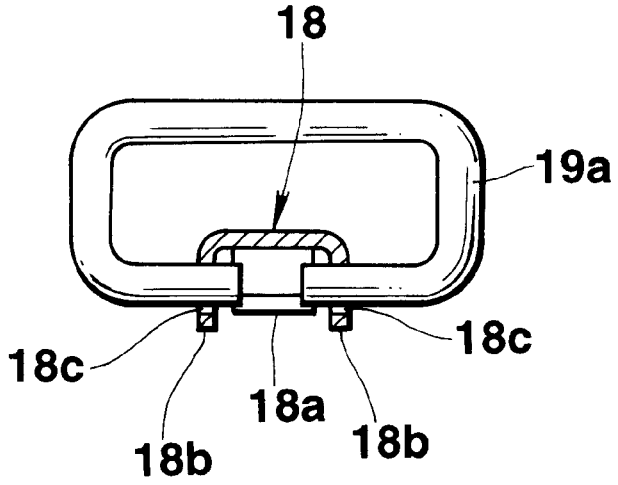
Figure 5A:
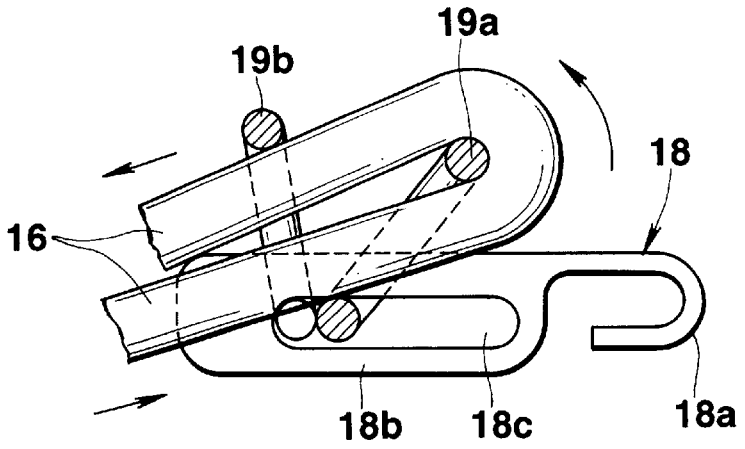
Figure 5B:
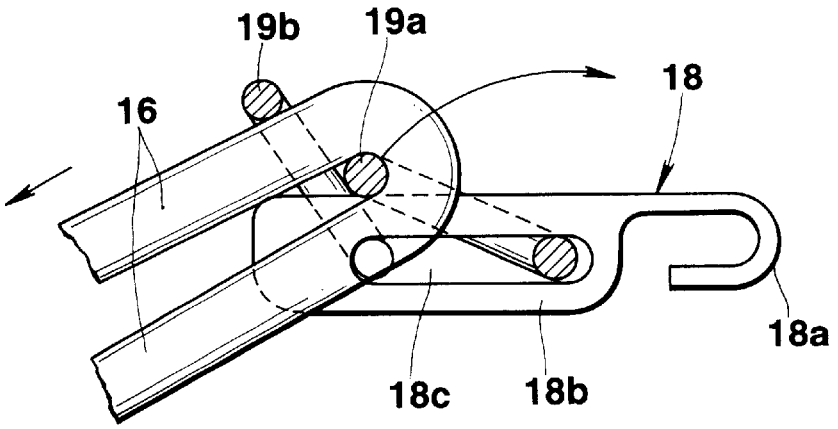

The clasping fixture 19 comprises, as shown in FIGS. 3A to 5B, a first clasping ring 19*a* into which the two separated strings 16 in outsides are inserted to be turned back from a left side to a right side in FIG. 5A, a second clasping ring 19*b* into which the two strings 16 turned back at the first clasping ring 19*a* in an inside are inserted from the right side to the left side, and a releasing ring 19*c* for releasing the clasping of the strings 16 clasped with the first and second clasping rings 19*a* and 19*b* by pulling up a back end of the hook member 18 to rotate. The portions of the first and second clasping rings 19*a* and 19*b* are, as shown in FIG. 3B, movably inserted into the long hole 18*c* of the both side portions 18*b* of the hook member 18, thereby the first and second clasping rings 19*a* and 19*b* are attached to the hook member 18 in a state that, as shown in FIG. 4A, the first clasping ring 1.9*a* is located in a right side and the second clasping ring 19*b* is located in a left side. A portion of the releasing ring 19*c* is rotatably attached to back ends, i.e., left end portions in FIG. 4A, of the both side portions 18*b* of the hook member 18.

In this case, the first clasping ring 19*a* has, as shown in FIGS. 3C and 4B, a rectangular shape projecting as a thickness of the string 16 into the both outsides of the both side portions 18*b* of the hook member 18. The second clasping ring 19*b* has, as shown in FIG. 3C, a D-like shape which is narrower than the first clasping ring 19*a* and projecting to upward from the vicinity of the both side portions 18*b* of the hook member 18. The releasing ring 19*c* has, as shown in FIGS. 3A and 4A, an elliptic shape projecting to backward from the back end, that is, the left end portion in the Figures, of the hook member 18. In the releasing ring 19*c*, position restricting projections, that is, position restricting portions 22 are formed, which restrict rotating positions of the releasing ring 19*c* by contacting to the both side portions 18*b* of the hook member 18 when the releasing ring 19*c* is rotated to upward of the hook member 18.

Figure 2:
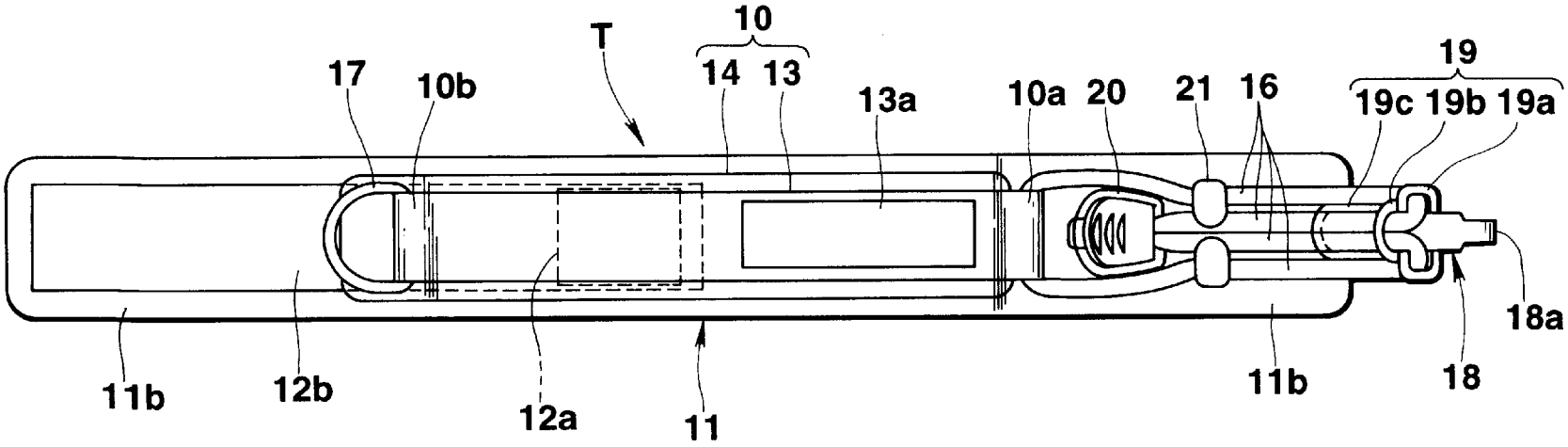
FIG. 2 is a plan view of FIG. 1, in a state that a case is detached therefrom.

As shown in FIG. 2, the two outside strings 16 separated in both sides are passed through outsides of the second clasping ring 19*b* along the both side portions 18*b* of the hook member 18, inserted into the first clasping ring 19*a* from the left side to the right side in FIG. 5A, and turned back. The turned back two inside strings 16 are grouped together and inserted into the second clasping ring 19*b* from the right side to the left side in FIG. 5A. In the state, the hook portion 18*a* of the hook member 18 is hooked to the connecting ring 17, thereafter the two inside strings 16 are pulled in a direction of parting from the hook member 18. Thereby, the first and second clasping rings 19*a* and 19*b* tighten and clasp the strings 16. In the state, when the back end of the hook member 18 is pushed up by raising the releasing ring 19*c*, and the hook member 18 is rotated about the hook portion 18*a* in the top end, the strings 16 clasped by the first and second clasping rings 19*a* and 19*b* are loosened.

The securing member 20 is, as shown in FIG. 2, for tying and securing each top end portion of the two strings 16 separated in both sides. The securing member 20 is attached to the top end portions of the strings 16 by sandwiching them, which is severed with being adjusted the length of them.

Figure 6:
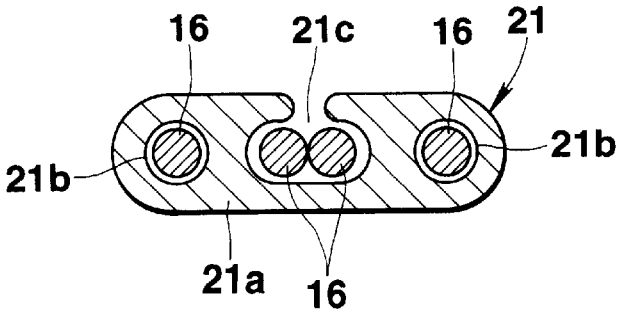
FIG. 6 is an enlarged cross-sectional view of a string holding piece of FIG. 2.

The string holding piece 21 comprises, as shown in FIGS. 2 and 6, a piece body 21*a* having a long thin bar-like shape of which both ends have a circular shape. In the both end portions, through holes 21*b* into which the two outside strings 16 are penetrated are formed. In the intermediate portion of the piece body 21*a*, a holding recess portion, i.e., a holding portion 21*c* is formed for holding the two inside strings 16 in the tied state, which is turned back by the clasping fixture 19.

Next, functions of the above-described watch band will be explained as follows.

Figure 7:
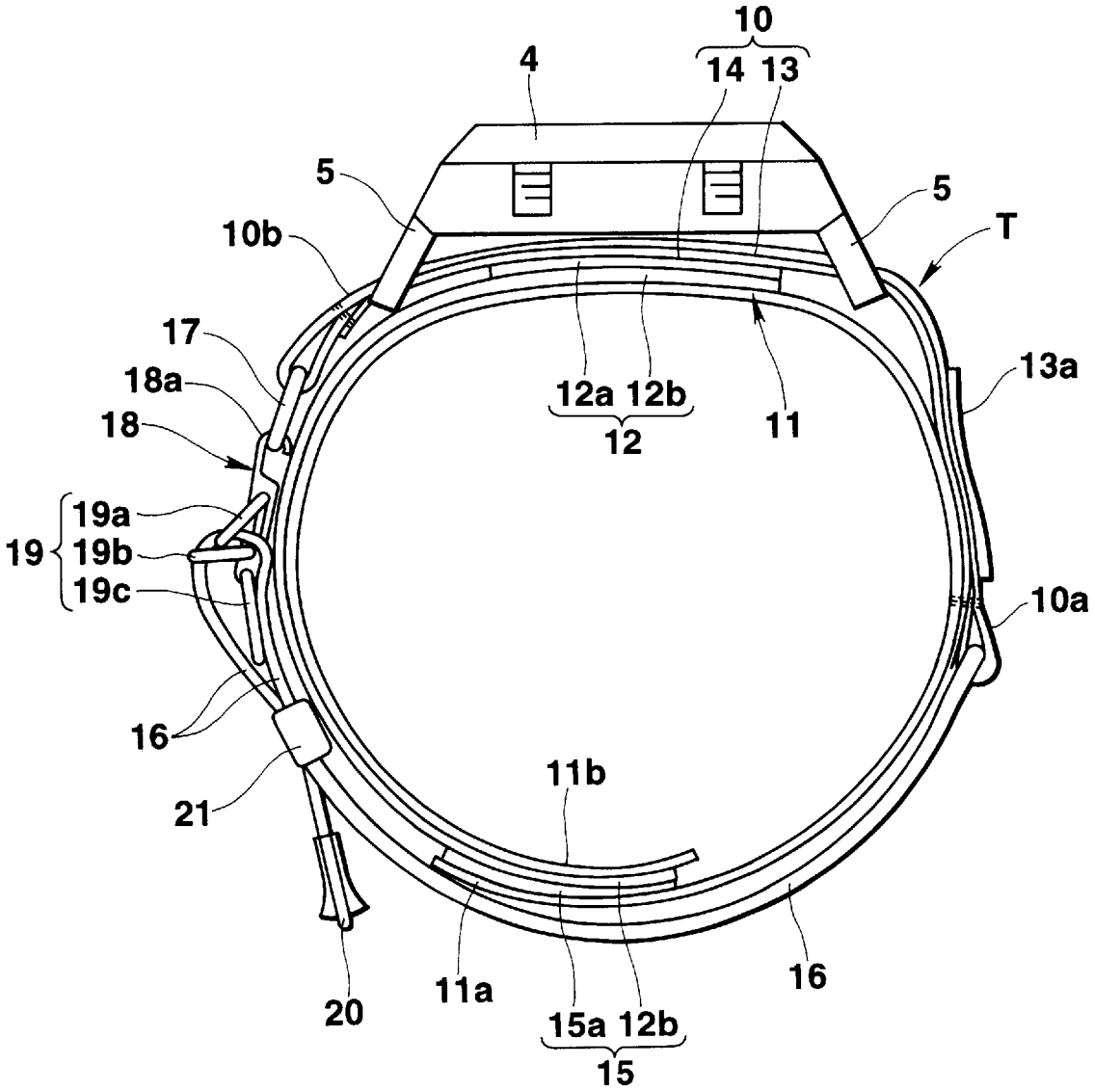
FIG. 7 is a view showing a state that the watch band of FIG. 1 is attached to the wrist.

In a case of putting the watch band on the wrist, as shown in FIG. 7, at first, the second band member 11 is wound around the wrist, thereby the right end portion 11*a* of the second band member 11 is overlapped on the left end portion 11*b* thereof. Then, the right end portion 11*a* and the left end portion 11*b* of the second band member 11 are fastened by the second fastening member 15, thereby the second band member 11 is temporarily secured to the wrist. In the state, the hook portion 18*a* of the hook member 18 connected to the string 16 at the right end portion 10*a* of the first band member 10 is hooked to the connecting ring 17 attached to the left end portion 10*b* of the first band member 10, thereafter the strings 16 in a side of the securing member 20 are pulled in the direction of parting from the hook member 18. Thereby, with tightening the second band member 11 by the first band member 10 to fit it to the wrist, the string 16 is tightened to be clasped by the first and second clasping rings 19*a* and 19*b* of the clasping fixture 19. Accordingly, it is possible to improve the handling for attaching of the watch band to the wrist, to easily control a degree of the fitness of the watch band to the wrist by controlling the strength of pulling the string 16, and to suitably attach the watch band to the wrist with fitting without slacking. Thereafter, the strings 16 in the side of the securing member 20 are inserted to the holding recess portion 21*c* of the string holding piece 21 to be secured; and the securing member 20 is, as shown in FIG. 2, placed and secured between the two strings 16 separated in the both sides. Thereby, it is possible to secure the securing member 20 and the string 16 to the watch band without dangling to become a hindrance.

In a case of detaching the watch band from the wrist, at first, the strings 16 in the side of the securing member 20 are taken out from the holding recess portion 21*c* of the string holding piece 21 to be moved in a side of the case 4, thereby the releasing ring 19*c* of the clasping fixture 19 is exposed. When the releasing ring 19*c* is picked to be pulled up, the position restricting portions 22 formed in the releasing ring 19*c* are brought into contact with the both side portions 18*b* of the hook member 18. Accordingly, the rotating position of the releasing ring 19*c* is restricted, thereby it becomes to easily pick the releasing ring 19*c*. In the state, when the back end of the hook member 18 is pulled up by the releasing ring 19*c*, and the hook member 18 is rotated upward about the hook portion 18*a* in the top end to be laid in a side of the connecting ring 17, it is possible to easily loosen to release the clasping of the string 16 clasped by the first and second clasping rings 19*a* and 19*b*. Accordingly, when the hook member 18 is rotated to be in the original state again, a play is occurred in the connecting of the hook portion 18*a* against the connecting ring 17 as the string 16 is loosened, thereby it is possible to simply and easily detach the hook portion 18*a* from the connecting ring 17. Thereafter, the both end portions 11*a* and 11*b* of the second band member 11 are pulled apart from each other, and the fastening with the second band member 11 by the second fastening member 15 is released, so that it is possible to easily detach the watch band from the wrist.

Figure 1:
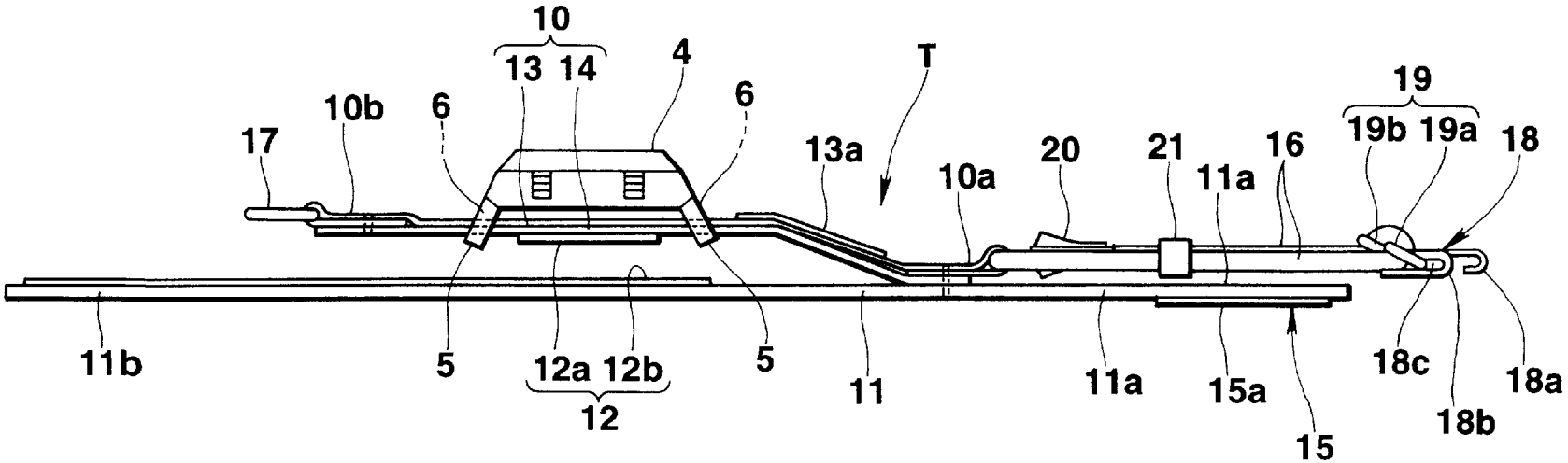
FIG. 1 is a side view of a watch band according to the first embodiment of the present invention.

In a case of exchanging the watch band to another one, as shown in FIG. 1, at first, the left end portion 10*b* of the first band member 10 and the left end portion 11*b* of the second band member 11 are pulled apart up and down, respectively, thereby each sheet fastener 12*a* and 12*b* of the first fastening member 12 is pulled apart from each other, so that the fastening between the first band member 10 and the second band member 11 by the first fastening member 12 is released. Then, the left end portion 10*b* of the first band member 10 is detached from the second band member 11 to be in a free state. In the state, the left end portion 10*b* of the first band member 10 is pulled out from each insertion hole 6 of the two band attachment portions 5 provided on the case 4, so that it is possible to easily detach the case 4 from the first band member 10. On the other hand, the left end portion 10*b* of the first band member 10 is inserted into each insertion hole 6 of the two band attachment portions 5 of the case 4, thereafter the first band member 10 and the second band member 11 are fastened by the first fastening member 12. Accordingly, it is possible to easily attach the case 4 to the first band member 10 and to attach the first band member 10 and the second band member 11 to each other. Therefore, it is possible to simply and easily exchange the watch band.

As above-described, according to the watch band, it is possible to improve the handling for attaching and detaching of the watch band to the wrist, to suitably attach the watch band to the wrist with fitting without slacking, and to simply and easily exchange the watch band to the case 4. Particularly, the first band member 10 has the length which is shorter than that of the second band member 11, and the both end portions 10*a* and 10*b* of the first band member 10 are connected through the string 16, the connecting ring 17 and the hook member 18. Accordingly, even if the watch band has a double layered structure when it is attached to the wrist, it is possible to obtain a watch band having a suitable design without a thick appearance of the band as a whole.

Figure 8:
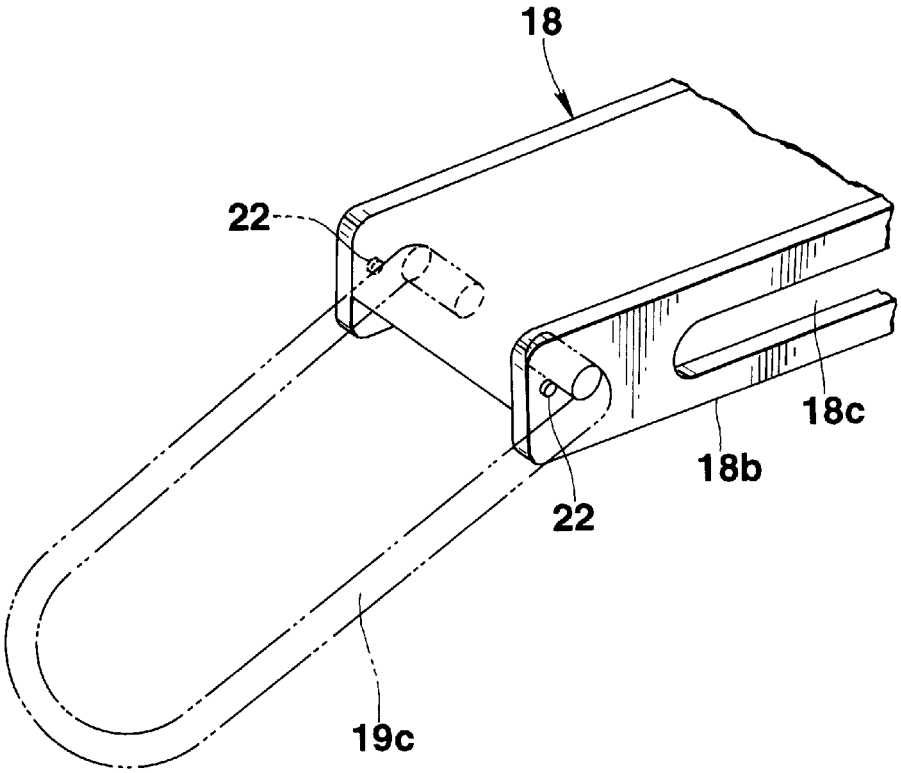
FIG. 8 is a view showing a position restricting member according to a modified example of the first embodiment.

In the first embodiment above-described, the releasing ring 19*c* of the clasping fixture 19 is provided with the position restricting projections 22; and the rotating position of the releasing ring 19*c* is restricted by that the position restricting projections 22 are contacted to the both side portions 18*b* of the hook member 18. However, it is not limited to that, for example, as shown in FIG. 8, the position restricting projections 22 can be provided on each outside surface of the both side portions 18*b* of the hook member 18. When the releasing ring 19*c* is rotated upward of the hook member 18, the releasing ring 19*c* is got over the position restricting projections 22, thereby the rotating position of the releasing ring 19*c* may be restricted.

Figure 9:
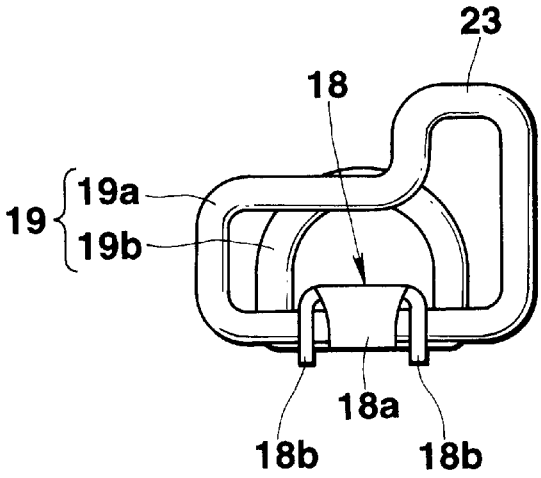
FIG. 9 is a view showing the first clasping ring in which a release handling portion is formed as a releasing means in place of a releasing ring in the first embodiment, according to a modified example of the first embodiment.

In the first embodiment above-described, the releasing ring 19*c* is attached to the back end of the hook member 18; and the hook member 18 is rotated by pulling up the back end thereof by the releasing ring 19*c*. However, it is not limited to that, for example, as shown in FIG. 9, a release handling portion 23 can be made as a body in one end portion of the first clasping ring 19*a* with projecting upward. In such a structure, the release handling portion 23 is picked to be rotated to be apart from the second clasping ring 19*b*, so that the string 16 clasped by the first and second clasping rings 19*a* and 19*b* can be loosened to be released.

Accordingly, it is not required the releasing ring 19*c* as another piece of the clasping fixture 19 in the first embodiment. Therefore, it is possible to reduce the number of pieces of the watch band, and to produce the watch band at a low cost using an easy fabrication method.

Figure 10:
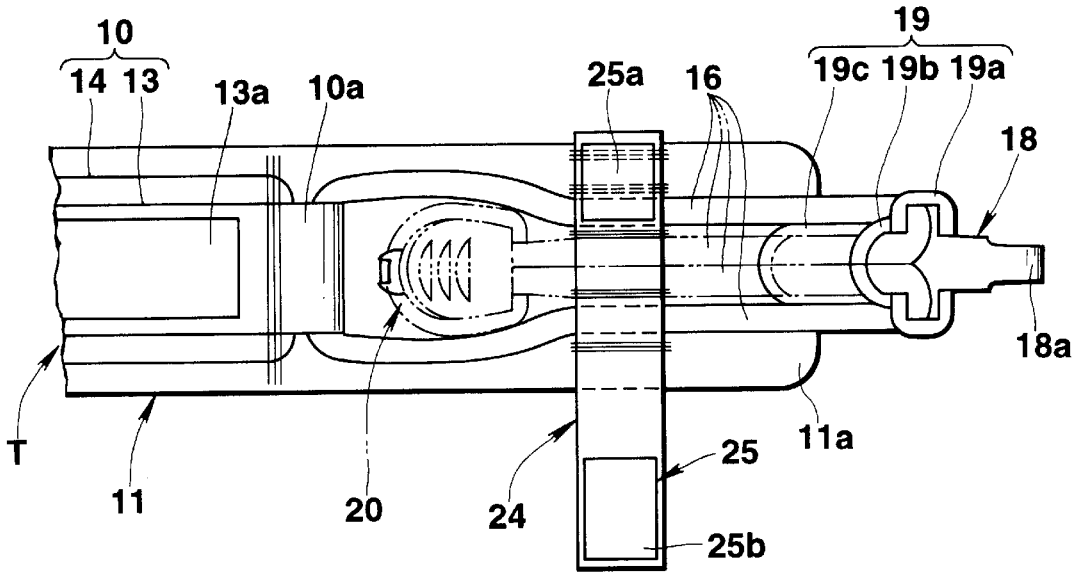
FIG. 10 is a view showing a string holding member according to a modified example of the first embodiment.

Further, in the first embodiment above-described, the holding recess portion 21*c* is formed in the piece body 21*a* of the string holding piece 21 attached movably to the string 16; and the string 16 in the side of the securing member 20 is secured in the holding recess portion 21*c* in the tied state. However, it is not limited to that, for example, as shown in FIG. 10, a string holding sheet 24 can be attached to a predefined portion in the side of the right end portion 11*a* of the second band member 11 by sewing so that the string 16 in the side of the securing member 20 may be secured in the tied state. The string holding sheet 24 is made of a strap-like cloth or the like which is longer than the width of the second band member 11 and disposed on the second band member 11 to cross the string 16 with covering the two outside strings 16 in the side of the right end portion 11*a* of the second band 11 and with adjusting an upper side of the second band 11 and an upper end of the string holding sheet 24 to each other. In this state, the string hold inch sheet 24 is secured to the second band member 11 by sewing the upper end thereof and both side portions of the two outside strings 16 in a state that the strings 16 can be passed between the string holding sheet 24 and the second band member 11. With the string holding sheet 24, a fastening portion 25 having a pair of sheet fasteners 25*a* and 25*b* for detachably fastening an upper end side and a lower end side of the string holding sheet 24 is disposed. The string 16 turned back at the clasping fixture 19 is disposed between the two outside strings 16 with crossing the string holding sheet 24. In the state, the lower end side of the string holding sheet 24 is turned back in the upper side; and the upper end portion and the lower end portion of the string holding sheet 24 are secured by the fastening portion 25. Accordingly, it is possible to secure the string 16 turned back at the clasping fixture 19 to the watch band without dangling to become a hindrance.

Second Embodiment:

Next, the band applied to a watch band, according to the second embodiment of the present invention will be explained with reference to FIGS. 11A to 11C. To structural members or the like in the second embodiment, corresponding to those of the first embodiment shown in FIGS. 1 to 7, the same reference numerals are attached, and the detailed explanation for them is omitted.

The watch band has the same structure as that in the first embodiment except that a hook member 26 and a clasping fixture 27, which are attached to the string 16 are different from the one in the first embodiment. In the case, the string 16 is, as the first embodiment, attached to the right end portion 10*a* of the first band member 10.

Figure 11A:
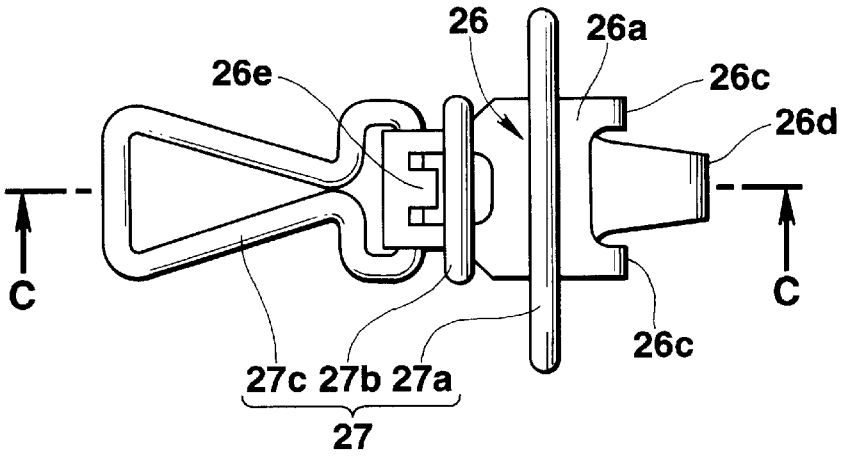
Figure 11B:
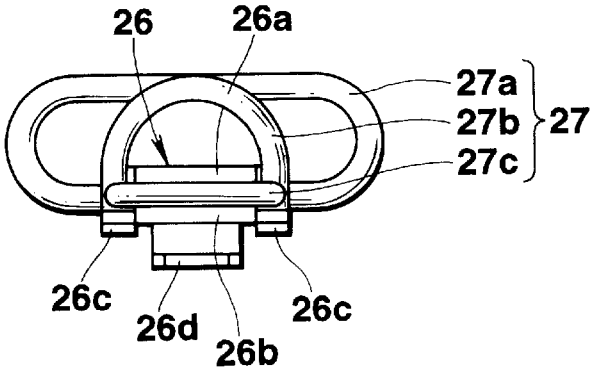

The hook member 26 is, as shown in FIGS. 11A and 11B, made of a metallic plate; a left end portion thereof is turned back with bending in arc-shaped; both ends 26*c* at right end portions of an upper plate portion 26*a* are bent to a lower side to be welded on a lower surface of a lower plate portion 26*b*; a right end portion of the lower plate portion 26*b* is projected to the right side between the both bent ends 26*c* of the upper plate portion 26*a*; a hook portion 26*d* is formed by bending the projected portion to the lower side to be turned back; and an attachment portion 26*e* having a circular shape is formed at the left end portion by cutting portions of the upper plate portion 26*a* and the lower plate portion 26*b*, in the left end sides to be bent in a circular shape.

Figure 11C:
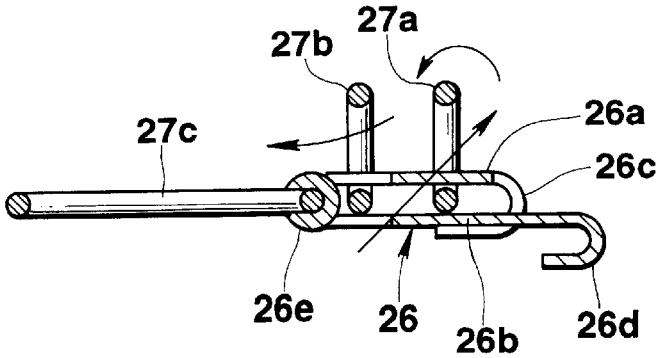

The clasping fixture 27 comprises, as shown in FIGS. 11A to 11C, approximately the same as the first embodiment, a first clasping ring 27*a* into which the two separated strings 16 in outsides are inserted to be turned back from the left side to the right side, a second clasping ring 27*b* into which the two inside strings 16 turned back at the first clasping ring 27*a* are inserted from the right side to the left side, and a releasing ring 27*c* for loosening the clasping of the strings 16 clasped by the first and second clasping rings 27*a* and 27*b* by pulling up a back end of the hook member 26 and rotating the hook member 26. Portions of the first and second clasping rings 27*a* and 27*b* are movably inserted between the upper plate portion 26*a* and the lower plate portion 26*b* of the hook member 26, thereby the first and second clasping rings 27*a* and 27*b* are attached to the hook member 26 in a state that the first clasping ring 27*a* is located in the right side and the second clasping ring 27*b* is located in the left side. A portion of the releasing ring 27*c* is rotatably attached to the attachment: portion 26*e* at the left end portion of the hook member 26.

In the case, the first clasping ring 27*a* has, as shown in FIGS. 11A and 11B, an oval shape projecting as a thickness of the string 16 into the both outsides of the hook member 26. The second clasping ring 27*b* has, as shown in FIG. 11B, a D-like shape which is narrower than the first clasping ring 27*a* and projecting to upward from the vicinity of the both sides of the hook member 26. The releasing ring 27*c* has, as shown in FIG. 11A, an approximately rectangular shape at a portion to be attached to the attachment portion 26*e* at the back end of the hook member 26, and a triangular shape gradually widening to the backward, i.e., the leftward in FIG. 11A from the rectangular shape.

As in the first embodiment, the two outside strings 16 shown in FIG. 2, and separated in the both sides are passed through outsides of the second clasping ring 27*b* along the both sides of the hook member 26, inserted into the first clasping ring 27*a* from the left side to the right side, and turned back. The turned back two inside strings 16 are grouped together and inserted into the second clasping ring 27*b* from the right side to the left side. In the state, the hook portion 26*d* of the hook member 26 is hooked to the connecting ring 17, thereafter the two strings 16 are pulled in a direction of parting from the hook member 26. Accordingly, the first and second clasping rings 27*a* and 27*b* tighten and clasp the stings 16. In the state, when the attachment portion 26*e* at the back end of the hook member 26 is pushed up by raising the releasing ring 27*c*, and the hook member 26 is rotated about the hook portion 26*d* at the top end, the strings 16 clasped by the first and second clasping rings 27*a* and 27*b* are loosened.

In a case of putting the watch band on the wrist, as the first embodiment, the second band member 11 is wound around the wrist, and the right end portion 11*a* and the left end portion 11*b* of the second band member 11 are secured by the second fastening member 15, thereby the second band member 11 is temporarily secured to the wrist. In the state,. the hook portion 26*d* of the hook member 26 connected to the string 16 at the right end portion 10*a* of the first band member 10 is hooked to the connecting ring 17 attached to the left end portion 10*b* of the first band member 10, thereafter the string 16 is pulled in the direction of parting from the hook member 26. Accordingly, with tightening the second band member 11 by the first band member 10 to fit it to the wrist, the string 16 is tightened to be clasped by the first and second clasping rings 27*a* and 27*b* of the clasping fixture 27. Therefore, as in the first embodiment, it is possible to improve the handling for attaching of the watch band to the wrist, to easily control a degree of the fitness of the watch band to the wrist by controlling the strength of pulling the string 16, and to attach the watch band to the wrist with suitable fitting without slacking.

In a case of detaching the watch band from the wrist, as in the first embodiment, the string 16 is moved in a side of the case complete 4, thereby the releasing ring 27*c* of the clasping fixture 27 is exposed. The releasing ring 27*c* is picked to be pulled up, thereby the attachment portion 26*e* at the back end of the hook member 26 is pulled up, and the hook member 26 is rotated about the hook portion 26*d* in the top end in the side of the connecting ring 17. Thereby, it is possible to easily loosen and release the clasping of the string 16 clasped by the first and second clasping rings 27*a* and 27*b*. Accordingly, as in the first embodiment, when the hook member 26 is rotated to be in the original state again, a play is occurred in the connecting of the hook portion 26*d* against the connecting ring 17 as the string 16 is loosened, thereby it is possible to simply and easily detach the hook portion 26*d* from the connecting ring 17.

In the second embodiment above-described, the releasing ring 27*c* of the clasping fixture 27 is simply attached to the attachment portion 26*e* of the hook member 26. However, it is not limited to this, for example, as the first embodiment shown in FIGS. 3A and 3B or the modified example thereof shown in FIG. 8, the position restricting projections can be provided on both sides of the releasing ring 27*c* or the attachment portion 26*e* of the hook member 26 so that the rotating position of the releasing ring 27*c* may be restricted by the position restricting projections.

Further, in the second embodiment above-described, the releasing ring 27*c* is attached to the attachment portion 26*e* at the back end of the hook member 26; and the hook member 26 is rotated by the releasing ring 27*c*. However, it snot limited to this. For example, as in the modified example of the first embodiment, as shown in FIG. 9, the release handling portion 23 can be made as a body in one end portion of the first clasping ring 27*a* with projecting upward. When the release handling portion 23 is picked and the first clasping ring 27*a* is rotated to be apart from the second clasping ring 27*b*, the string 16 clasped by the first and second clasping rings 27*a* and 27*b* can be loosened to be released.

Third Embodiment:

Next, the band applied to a watch band, according to the third embodiment of the present invention will be explained with reference to FIGS. 12 to 15. To structural members or the like in the third embodiment, corresponding to those of the first embodiment shown in FIGS. 1 to 7, the same reference numerals are attached, and the detailed explanation for them is omitted.

The watch band has approximately the same structure as that in the first embodiment except that a string 16 to be attached to the right end portion 10*a* of the first band member 10, a hook member 30 and a sliding piece, that is,, a clasping member 31, which are attached to the string 16 are different from the one in the first embodiment. In the case, the first band member 10 is made of inelastic cloth and has a single layered structure. The string 16 is attached to the right end portion 10*a* of the first band member 10, while the connecting ring 17 is attached to the left end portion 10*b* thereof. The right end portion 10*a* of the first band member 10 wraps a portion of the string 16 to be turned back; and the turned back portion is secured to the first band member 10 together with the second band member 11 by sewing. The left end portion 10*b* of the first band member 10 is inserted into the connecting ring 17 to be turned back; and the turned back portion is attached to the first band member 10 by sewing, thereby the left end portion 10*b* is in a free state against the second band member 11.

The string 16 has no end portion. With the string 16, a portion of which is attached to the right end portion 10*a* of the first band member 10 and the string 16 is separated in two portions from the right end portion 10*a* in both sides of the right end portion 10*a*. The two portions of the string 16 are extended to the right end portion 11*a* of the second band member 11 from the right end portion 10*a* of the first band member 10; and the extended portions are attached to the right end portion 11*a* of the second band member 11 by sewing to be turned back.

Figure 14:
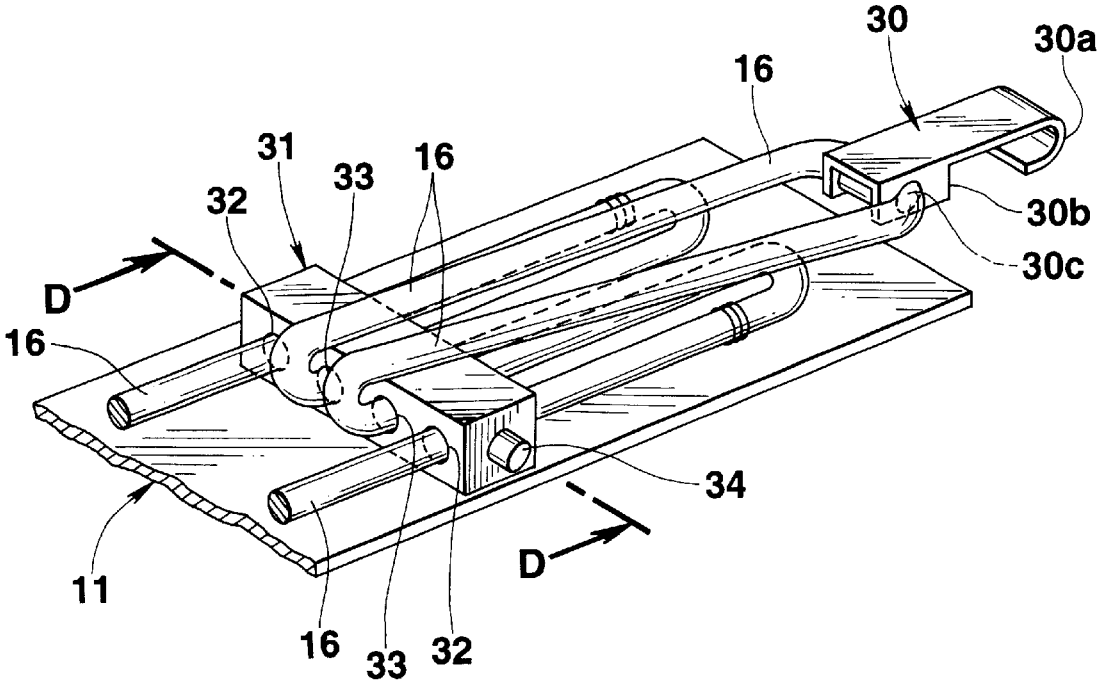
FIG. 14 is a partly enlarged perspective view of FIG. 13.

The hook member 30 is movably attached to a top end of the string 16 extended to the right end portion la of the second band member 11, i.e., it is movably attached to an intermediate portion of the string 16, positioned at the right 3ide thereof. The hook member 30 is, as shown in FIG. 14, made of a metallic plate having a rectangular shape; in a top end thereof, that is, a right end portion in the Figure, a hook portion 30*a* is formed to be turned back by bending downwardly; at both sides along in a longitudinal direction of the second band member 11, both side portions 30*b* are formed by bending downwardly; and in the both end portions 30*b*, attachment holes 30*c* into which the string 16 is penetrating are formed.

Figure 12:
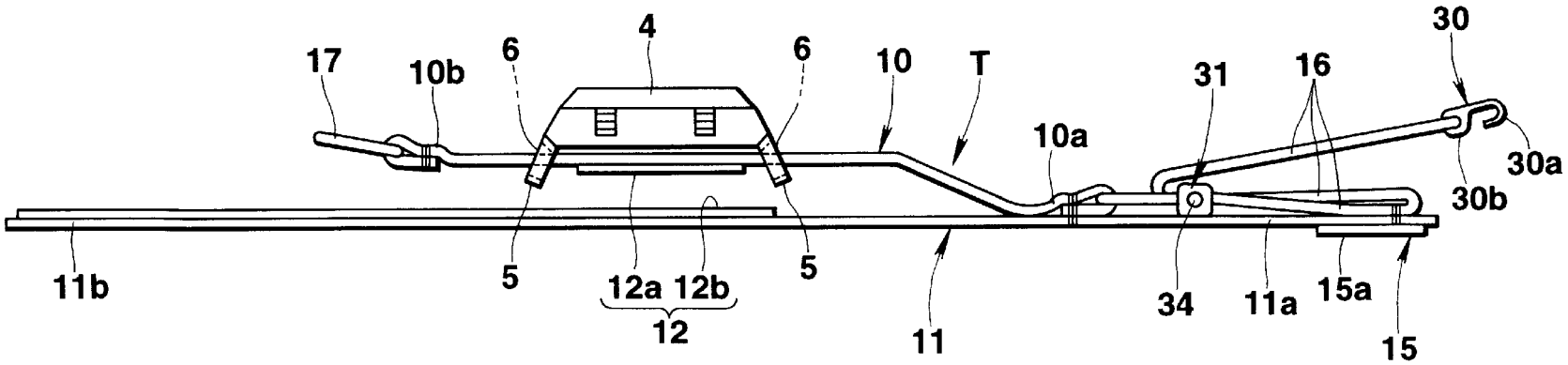
FIG. 12 is a side view showing a watch band according to the third embodiment of the present invention.
Figure 13:
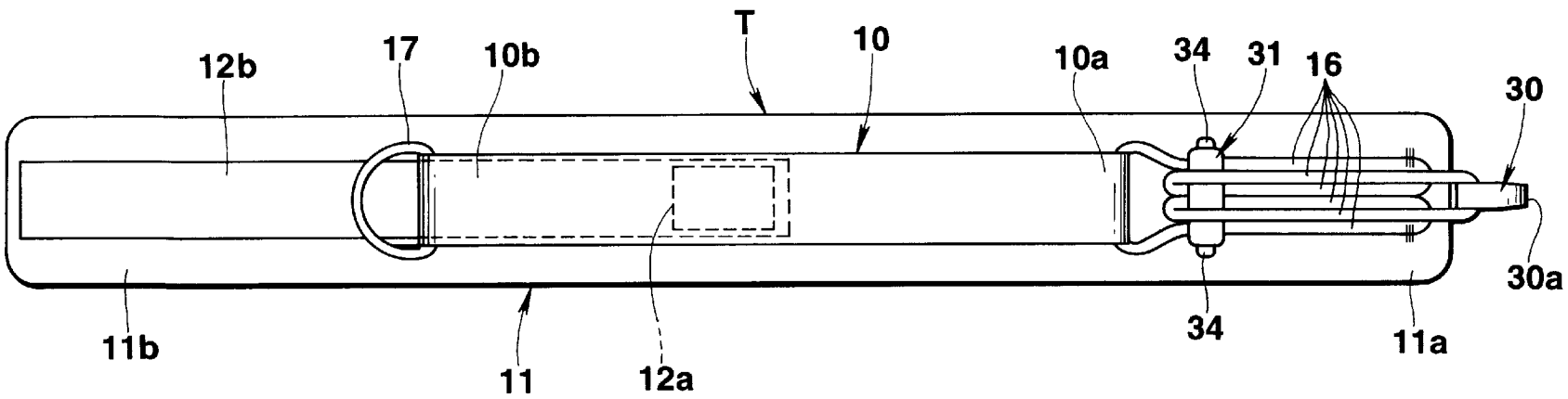
FIG. 13 is a plan view of FIG. 12, in a state that a case is detached therefrom.
Figure 15:
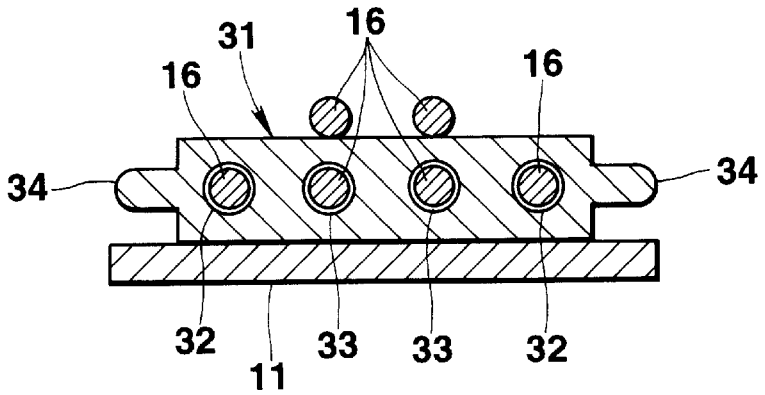
FIG. 15 is an enlarged cross-sectional view taken the line 15D—15D of FIG. 14.

The sliding piece 31 as a clasping fixture is, as shown in FIGS. 12 and 13, disposed between the right end portion 10*a* of the first band member 10 and the right end portion 11*a* of the second band member 11. In the sliding piece 31, as shown in FIGS. 14 and 15, two first insertion holes 32 are formed at both sides, into which the two outside strings 16 extended to the right end portion 11*a* of the second band member 11 from the right end portion 10*a* of the first band member 10 are penetrated from the left side to the right side in FIG. 14; and two second insertion holes 33 are formed at intermediate portions, into which the two inside strings 16 secured to the right end portion 11*a* of the second band member 11 by sewing to be turned back are penetrated from the right side to the left side in FIG. 14. In this case, the strings 16 penetrated into the second insertion holes 33 are turned back with the sliding piece 31 to the right side on an upper side of the sliding piece 31. The hook member 30 is attached to the top end of the turned back strings 16. On the both end surfaces of the sliding piece 31, handling projections 34 are disposed with projecting to each sideward.

In a case that the watch band is put on the wrist, as in the first embodiment, the second band member 11 is wound around the wrist, and the right end portion 11*a* and the left end portion 11*b* of the second band member 11 are secured by the second fastening member 15, thereby the second band member 11 is temporarily secured to the wrist. In this state, the hook portion 30*a* of the hook member 30 attached to the string 16 at the right end portion 10*a* of the first band member 10 is hooked to the connecting ring 17 attached to the left end portion 10*b* of the first band member 10, thereafter the sliding piece 31 is slid in the direction of parting from the hook member 30. The sliding piece 31 is slid along the two outside strings 16 penetrated into the first insertion hole 32, and the two strings 16 turned back at the sliding piece 31 is drawn to the side of the right end portion 10*a* of the first band member 10. Thereby, the hook member 30 is pulled. Accordingly, with tightening the second band member 11 by the first band member 10 to fit it to the wrist, the string 16 is clasped by the sliding piece 31. Therefore, as in the first embodiment, it is possible to improve the handling for attaching of the watch band to the wrist, to easily control a degree of the fitness of the watch band to the wrist by controlling the strength of pulling the sliding piece 31, and to attach the watch band to the wrist with suitable fitting without slacking.

In a case of detaching the watch band from the wrist, when the sliding piece 31 is slid toward the hook member 30, the two strings 16 turned back at the sliding piece 31 are loosened as the sliding piece 31 is slid in the side of the hook member 30, thereby it is possible to simply and easily detach the hook portion 30*a* from the connecting ring 17. Thereafter, the both end portions 11*a* and 11*b* of the second band member 11 are pulled apart from each other, and the fastening of the second band member 11 by the second fastening member 15 is released, so that it is possible to easily detach the watch band from the wrist.

As above-described, according to the watch band, as in the first embodiment, it is possible to improve the handling for attaching and detaching of the watchband to the wrist, to attach the watch band to the wrist with suitable fitting without slacking, and to simply and easily exchange the watch band against the case complete 4. Particularly, because the two strings 16 turned back at the sliding piece 31 are pulled or loosened by sliding of the sliding piece 31, the top end portion of the strings 16 does not remain as the first embodiment. Therefore, it is does not require the string holding piece 21 for, so that it is possible to obtain the watch band having easier structure.

In the third embodiment above-described, the string 16 is simply penetrated into the first and second insertion holes 32 and 33 of the sliding piece 31. However, it is not limited to this. For example, the handling projections 34 can have a structure utiliging a side-push method. In the structure, a spring member is disposed in the sliding piece 31. Then, the handling projections 34 can be energised by the spring member in a direction of being pushed out, so that the string 16 can be clasped at least in the first insertion holes 32 with being sandwiched. When the handling projections 34 are pushed against the spring force, the clasping of the string 16 can be released. In the structure, it can be possible to more certainly clasp or secure the string 16 and sliding piece 31.

Figure 16:
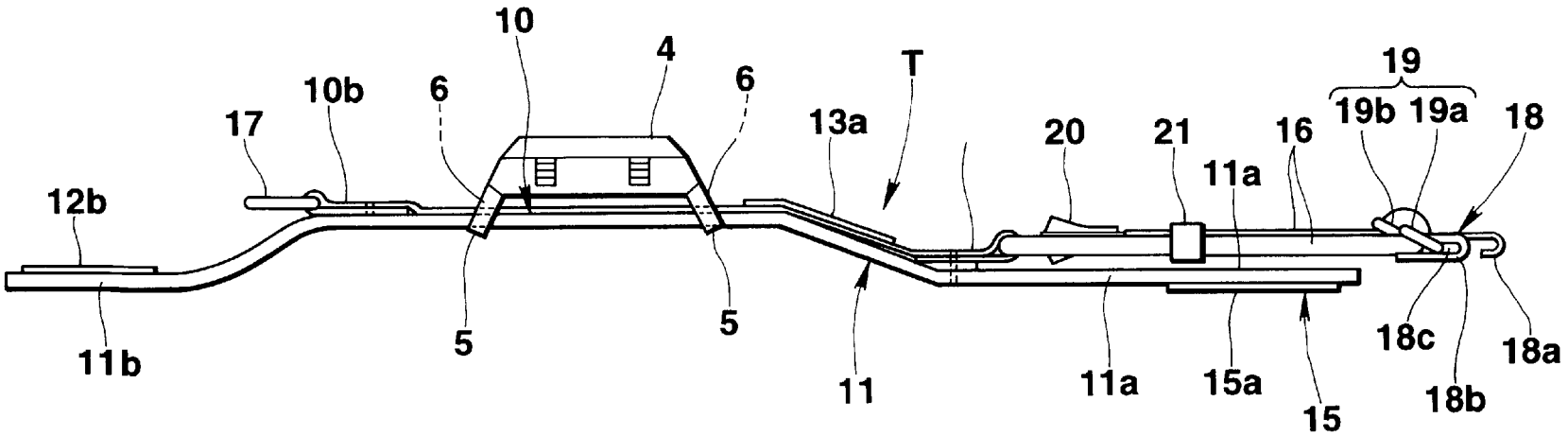
FIG. 16 is a view showing a watch band attached to band attachment portions of the case in a state of overlapping the first and second band members to each other according to a modified example.

In the above-described first to third embodiments, the case 4 is attached to the first band member 10 which is overlapped on and attached to the second band member 11, however, it is not limited to this. For example, as shown in FIG. 16, the case 4 can be attached to the band body T having the first band member 10 and the second band member 11, which are overlapped to each other. Further, in the case that the band body T has the double layered structure having the first band member 10 and the second band member 11, however, the band body T can comprise only the first band member 10. In this case, the both ends of the string 16 in the third embodiment can be attached to the first band member 10 by sewing. The string 16 can be extended to the right end portion 10*a* of the first band member 10 from the attached portion, and attached thereto by sewing to be turned back.

Further, in the above-described first to third embodiments, the watch bands to which the case 4 is attached are described, however, it is not limited to this. For example, the band in the present invention can be applied widely to a band to which a wrist member, such as an accessory, a pedometer, a compass, or the like is attached.

As above-described, according to the first to third embodiments, as shown in FIGS. 1 to 16, the band comprises: a band body (T); a connecting member (the connecting ring 17) attached to one end portion of the band body; a string member (the string 16) attached to the other end portion of the band body; a hook member (18, 26, or 30) connected to the string member, for detachably hooking the connecting member, wherein when the hook member is hooked to the connecting member and the string member is pulled, the string member tightens the band body; and a clasping member (19, 27, or 31) for clasping the string member, and for loosening to release a tightening of the band body.

For the clasping member, as shown in FIGS. 1 to 5B, the clasping fixture 19 is applied, which comprises the first clasping ring 19*a* movably attached to the long hole of the hook member and having the rectangular shape, the second clasping ring 19*b* movably attached to the long hole of the hook member and having the D-like shape, and the releasing ring 19*c* rotatably attached to the back end of the hook member and having the elliptic shape.

For the clasping member, as shown in FIGS. 11A to 11C, the clasping fixture 27 is also applied, which comprises the first clasping ring 27*a* movably attached to the hook member between the upper plate portion and the lower plate portion thereof and having the rectangular shape, the second clasping ring 27*b* movably attached to the hook member between the upper plate portion and the lower plate portion thereof and having the D-like shape, and the releasing ring 27*c* rotatably attached to the attachment portion at the back end of the hook member.

The band body comprises, as shown in FIGS. 1, 2, 7, 12, and 16, the first band member 10 and the second band member 11 detachably attached underneath the first band member 10 with overlapping each other. To the left end portion 10*b* of the first band member, the connecting member is attached. To the right end portion 10*a* of the first band member, the string member is attached. To the string member, the hook member is connected through the clasping member. In the case, a wrist member (4) is detachably attached to the first band member.

On the both end portions of the second band member, as shown in FIGS. 1, 7, and 16, the band comprises a pair of fastening members (the sheet fasteners 12*b* and 15*a*) for detachably fastening the both ends. On the facing surfaces, of the first band member and the second band member, as shown in FIGS. 1 and 7, the band comprises a pair of fastening members (the sheet fasteners 12*a* and 12*b*) for detachably fastening the first and second band members.

To the band body, as shown in FIGS. 1, 7, and 16, a wrist member (4) is detachably attached. For the wrist member, as shown in FIGS. 1, 7, and 16, the watch 4 is applied. Through the band attachment portions 5 and 5 provided on the watch, the watch is detachably attached to the first band member or the band body comprising the first band member and the second band member, which are overlapped to each other.

According to the invention, as shown in FIGS. 1 to 16, a band comprises: a band body (T); a connecting member (the connecting ring 17) attached to one end portion of the band body; a string member (the string 16) attached to the other end portion of the band body; a hook member (18, 26, or 30) connected to the string member, for detachably hooking the connecting member, wherein when the hook member is hooked to the connecting member and the string member is pulled, the string member tightens the band body; and a clasping member (the clasping fixture 19, 27, or 31) for clasping the string member, and for loosening to release a tightening of the band body.

According to the invention, when the band body is attached to the wrist or the like, at first, the band body is disposed on the wrist or the like. Next, the hook member connected to the string member is hooked to the connecting member attached to one end portion of the band body; in the state, the string is pulled, thereby the string member is clasped by the clasping member. Accordingly, it is possible to attach the band body to the wrist or the like. Therefore, it is possible to easily attach the band body to the wrist or the like and to attach the band body thereto with suitable fitting without slacking. On the other hand, when the band body is detached therefrom, the clasping of the string member is loosened to be released by the clasping member, thereby it is possible to easily release the hooking of the hook member to the connecting member. Accordingly, it is possible to easily detach the band body from the wrist or the like. Therefore, it is possible to improve the handling for attaching and detaching of the band body.

The hook member can have various shapes. To the hook member, for example, as shown in FIGS. 1 to 5B, a hook member (18) can be applied, which is made of a metallic plate having an approximately rectangular shape; in a top end thereof, a hook portion is formed; both side portions are formed at both sides thereof; and a long hole is formed in the both side portions.

A hook member (26) can be also applied, as shown in FIGS. 11A to 11C, which is made of a metallic plate; a left end portion thereof is turned back; both ends at a right end portion of an upper plate portion are welded on a lower plate portion; a right end portion of the lower plate portion is projected to the right side to form a hook portion; and an attachment portion having a circular shape is formed at the left end portion.

The clasping member can have various shapes. To the clasping member, for example, as shown in FIGS. 1 to 5B, the clasping fixture 19 can be applied, which comprises the first clasping ring 19*a* movably attached to the hook member and having the rectangular shape, the second clasping ring 19*b* movably attached to the hook member and having the D-like shape, and the releasing ring 19*c* rotatably attached to the back end of the hook member and having the elliptic shape. As shown in FIGS. 11A to 11C, the clasping fixture 27 can be also applied, which comprises the first clasping ring 27*a* movably attached to the hook member and having the rectangular shape, the second clasping ring 27*b* movably attached to the hook member and having the D-like shape, and the releasing ring 27*c* rotatably attached to the attachment portion at the back end of the hook member.

The band body comprises, as shown in FIGS. 1, 2, and 7, a first band member (10) and a second band member (11) detachably attached underneath the first band member with overlapping each other. To one end portion of the first band member, the connecting member is attached. To the other end portion of the first band member, the string member is attached. To the string member, the hook member is connected through the clasping member. In the case, a wrist member (4) is detachably attached to the first band member.

On the both end portions of the second band member, the band comprises a pair of fastening members (the sheet fasteners 12*b* and 15*a*) for detachably fastening the both ends.

On the facing surfaces, of the first band member and the second band member, the band comprises a pair of fastening members (the sheet fasteners 12*a* and 12*b*) for detachably fastening the first and second band members.

To the band body, for example as shown in FIGS. 1, 2, and 7, a wrist member (4) is attached. For the wrist member, a watch (4) is applied. Through band attachment portions (5 and 5) provided on the watch, the watch is attached to the band body.

As above-described, according to the band in the present invention, when a band body is attached to the wrist or the like, at first, the band body is disposed on the wrist or the like. A hook member connected to a string member is hooked to a connecting member attached to one end portion of the band body. In the state, when the string member is pulled, the band body can be attached to the wrist or the like by that a clasping member clasps the string member. Accordingly, it is possible to easily attach the band body to the wrist or the like with suitable fitting without slacking. On the other hand, when the band body is detached therefrom, because the clasping of the string member is loosened to be released by the clasping member, it is possible to easily release the hooking of the hook member against the connecting member. Accordingly, it is possible to easily detach the band body therefrom. Therefore, it is possible to improve the handling for attaching and detaching of the band body.

What is claimed is:

1. A band comprising:

a band body;

a connecting member attached to a first end portion of the band body;

a string member attached to a second end portion of the band body;

a fastening member connected to the string member for detachably fastening the connecting member, said fastening member comprising a side portion with a long hole extending in a longitudinal direction thereof;

a first clasping ring which is movably inserted into the long hole of the side portion of the fastening member, and which is arranged at a position in a free end side of the fastening member;

a second clasping ring which is movably inserted into the long hole of the side portion of the fastening member, and which is arranged at a position in the long hole between the first clasping ring and the other end side of the fastening member; and a releasing ring attached to the fastening member in the other end side of the fastening member;

wherein the string member is tightened by pulling the string member through the first clasping ring and the second clasping ring after fastening the connecting member to the fastening member, and tightening of the string member is released by rotating the releasing ring.

2. The band as claimed in claim 1, wherein the connecting member has a ring shape, and the fastening member comprises a hook portion at a free end thereof, and wherein the connecting member is fastened to the fastening member by fastening the hook portion to a portion of the ring shape of the connecting member.

3. The band as claimed in claim 1, wherein a case is attached to the band body.

4. The band as claimed in claim 3, wherein the band body comprises a band attachment portion at which the case is attached.

5. A band comprising:

a first band member to which a case is adapted to be detachably attached;

a connecting member attached to a first end portion of the first band member;

a string member attached to a second end portion of the first band member;

a fastening member connected to the string member for detachably fastening the connecting member, said fastening member comprising a side portion with a long hole extending in a longitudinal direction thereof;

a first clasping ring which is movably inserted into the long hole of the side portion of the fastening member, and which is arranged at a position in a free end side of the fastening member;

a second clasping ring which is movably inserted into the long hole of the side portion of the fastening member, and which is arranged at a position in the long hole between the first clasping ring and the other end side of the fastening member;

a releasing ring attached to the fastening member in the other end side of the fastening member; and a second band member disposed underneath the first band member such that the first band member overlaps the second band member;

wherein the string member is tightened by pulling the string member through the first clasping ring and the second clasping ring after fastening the connecting member to the fastening member, and tightening of the string member is released by rotating the releasing ring.

6. A band as claimed in claim 5, wherein the connecting member has a ring shape, and the fastening member comprises a hook portion at a free end thereof, and wherein the connecting member is fastened to the fastening member by fastening the hook portion to a portion of the ring shape of the connecting member.

7. The band as claimed in claim 5, wherein the second band member is integrally attached to the first band member at a position between the first and second end portions of the first band member.

8. The band as claimed in claim 5, wherein a pair of fastening members are provided on both ends of the second band member for detachably fastening the both ends.

9. The band as claimed in claim 5, wherein a pair of fastening members are provided on facing surfaces of the first and second band members for detachably fastening the first and second band members.

* * * * *